United States Patent [19]

Donze et al.

[11] 4,074,513

[45] Feb. 21, 1978

[54] ELECTRONIC DISPLAY DEVICE

[75] Inventors: Jean-Marie Donze; Georges Vuffray, both of La-Chaux-de-Fonds, Switzerland

[73] Assignee: Girard-Perregaux S.A., Switzerland

[21] Appl. No.: 683,282

[22] Filed: May 5, 1976

[30] Foreign Application Priority Data

May 7, 1975 Switzerland ..... 5903/75

[51] Int. Cl.[2] ..... G04B 27/08; G04C 3/00

[52] U.S. Cl. ..... 58/4 A; 58/23 R; 58/50 R; 58/58; 58/85.5

[58] Field of Search ..... 58/4 A, 23 R, 50 R, 58/58, 85.5

[56] References Cited

U.S. PATENT DOCUMENTS

| | | | |
|---|---|---|---|
| 3,765,163 | 10/1973 | Levine et al. | 58/50 R |
| 3,795,098 | 3/1974 | Fujita | 58/85.5 |
| 3,871,168 | 3/1975 | Maire et al. | 58/23 R |
| 3,978,296 | 8/1976 | Moriya et al. | 58/23 R X |
| 3,994,124 | 11/1976 | Fujita | 58/23 R |
| 4,022,017 | 5/1977 | Aoki et al. | 58/23 R X |
| 4,024,678 | 5/1977 | Portmann et al. | 58/23 R |

*Primary Examiner*—Stanley J. Witkowski

*Attorney, Agent, or Firm*—Stevens, Davis, Miller & Mosher

[57] ABSTRACT

A circuit for an electronic timepiece which utilizes only one push button to adjust the contents of the minutes, hours, and date counters of the display circuitry is provided. The circuit utilizes an input circuit and associated timer for generating activating and intervention signals at selected points in time in response to depressions of the push button, a cyclical activation circuit rendered operative in response to the concurrent presence of activating and intervention signals for sequentially energizing intervention circuits connected to respective counters, and an intervention connection for coupling intervention signals from the input circuit directly to energized intervention circuits which cause an adjustment in the contents of a respective counter.

10 Claims, 4 Drawing Figures

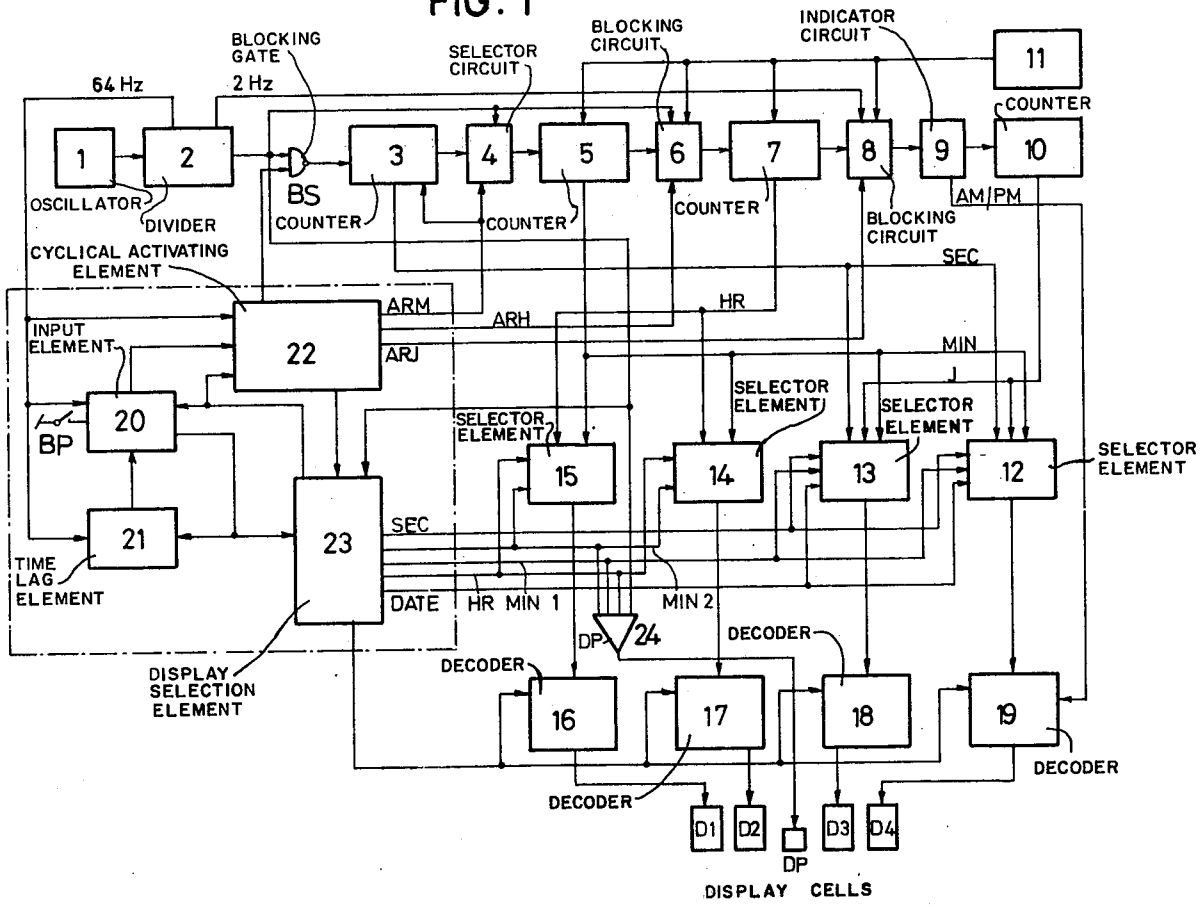
FIG. 1
64 Hz
OSCILLATOR
DIVIDER
2 Hz
BLOCKING GATE
BS
COUNTER
SELECTOR CIRCUIT
BLOCKING CIRCUIT
COUNTER
INDICATOR CIRCUIT
BLOCKING CIRCUIT
COUNTER
AM/PM
COUNTER
ARM
ARJ
ARH
HR
SEC
MIN
CYCLICAL ACTIVATING ELEMENT
INPUT ELEMENT
BP
TIME LAG ELEMENT
SEC
DATE
HR
MIN 1
MIN 2
DP
SELECTOR ELEMENT
SELECTOR ELEMENT
SELECTOR ELEMENT
SELECTOR ELEMENT
DECODER
DECODER
DECODER
DECODER
DISPLAY SELECTION ELEMENT
DISPLAY CELLS
D1
D2
D3
D4
DP

ELECTRONIC DISPLAY DEVICE

This invention relates to electronic display devices. More particularly, it relates to electronic display devices for timepieces, of the type comprising a plurality of display cells, a plurality of counters for processing data to be transmitted to the display cells, a plurality of intervention elements respectively connected to the inputs of the counters, and a control circuit connected to the intervention elements for enabling modification of the data.

Several solutions have already been proposed to the problem posed by the control circuit in electronic devices of this kind. In the case of wrist watches where the electronic display device comprises digital display cells, e.g., liquid cyrstal or LED cells, the control means often includes an input connected to a contact on the watchcase, and the display is corrected by connecting the watch to a suitable outside apparatus. However, it has already been attempted to obviate the necessity of using an outside accessory for setting the watch, or for correcting the data or time indication, by designing electronic display devices where the entire control circuit is incorporated in the watch.

In certain known devices (cf. Swiss Published Application No. 10216/73, French Pat. No. 2,162,539, and German Disclosed Application No. 2,439,150), the intervention elements are connected to the various outputs of a distributor element which is controlled by a first switch. If this switch is closed for any one of a number of differing periods, or if it is operated a certain number of times in succession, a signal capable of activating a corresponding one of the intervention elements is caused to appear at a corresponding one of the outputs of the distributor element. This preparatory operation is followed by the correction operation proper in which another switch is operated, whereby pulses of a predetermined frequency are transmitted to the counter corresponding to the activated intervention element, which pulses change the state of the counter and, consequently, the indication displayed by the corresponding cell or cells.

In some of these known devices, the control circuit returns to its normal state automatically after a certain period of time has elapsed. In other devices, a special switch must be operated in order to return the circuit to its normal state, whereas in still other devices, an additional operation using either the preparation switch or the correction switch is necessary for returning the control circuit to its inactive state.

These prior art timepieces comprise at least two movable control members mounted on the watchcase, e.g., two push buttons, or a mechanical control member having several functions, such as a crown which can be moved in and out and turned. Besides the fact that such arrangements detract from the appearance of the watchcase by having several projecting elements or being bulky, they also require that a certain program be carried out, which the wearer is supposed to remember, and which may, in certain cases, be relatively complicated according to what kind of interventions are desired.

It is an object of this invention to provide an electronic display device which remedies these drawbacks by having a control circuit enabling interventions of various kinds to be carried out on the display device with control means which are as simple to operate as possible, and particularly with control means comprising only one push button which closes a circuit when pressed and reopens that circuit when released.

To this end, in the electronic display device according to the present invention, the control circuit comprises an input element producing activating signals and intervention signals, a switch connected to the input element, a cyclical activating element having an input channel connected to the input element and a plurality of output channels each connected to at least one of the intervention elements, and an intervention connection directly connecting the input channel to the output channels for transmitting the intervention signals to the output channels, the activating element activating the output channels successively in a predetermined order when energized by an activating signal, an activated output channel transmitting an intervention signal to its associated intervention element while the activating element is energized.

A preferred embodiment of the invention will now be deribed in detail with reference to the accompanying drwing, in which:

FIG. 1 is a block diagram of the circuitry of a timepiece,

Figure 2:
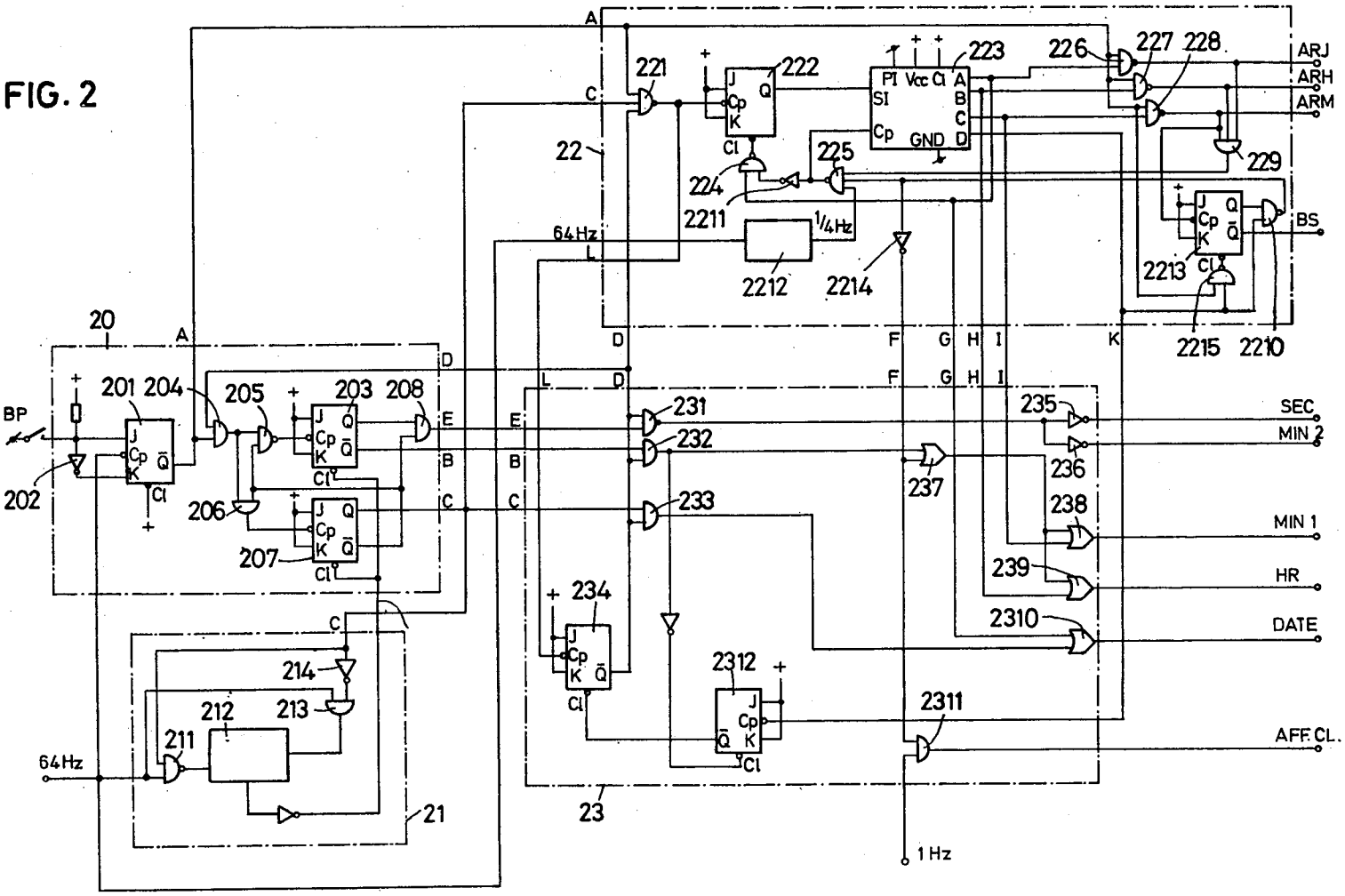
FIG. 2 is a basic diagram of the control circuit.

The principle of the system to be described below consists in controlling various functions of the control circuit by pressing a single push button a number of times in succession. Pressing it once energizes an activating element which successively activates several connections in accordance with a certain program. If the same button is pressed again during the activating cycle, the output channel activated at the moment when this happens transmits an intervention signal which modifies one or the other of the indications displayed. For example, in a display of hours and minutes, pressing the button for a second time may cause the rapid advance of the hour indication or of the minute indication, depending upon the state of the activating cycle at the moment when the button is pressed. In the case of a correction of the minute display, this second pressing of the button will also cause the seconds counter to be blocked and the activating cycle to be extended, so that at the proper moment, the button will have to be pressed again in order to restart the counting of the seconds from zero and to return the control circuit to its normal state.

In the embodiment about to be described, although the display device is designed to perform still other functions, a single push button BP suffices to control it. The module of the timepiece to be described may be produced in the size of a wrist watch and be powered by a miniature battery, e.g., of 1.5 V. FIG. 1 shows circuitry for a timepiece employing the present invention. It comprises a quartz oscillator 1 oscillating, for example, at 32 kHz, a divider chain 2 which reduces the frequency of the output signal from oscillator 1 to 1 Hz while at the same time transmitting a 64-Hz signal and a 2Hz signal at secondary outputs. The 1-Hz signal is transmitted to the input of the counting circuit. The latter comprises four counters 3, 5, 7, and 10, each processing particular time data at lateral outputs, viz., seconds for counter 3, minutes for counter 5, hours for counter 7, and the date for counter 10. The data processed by these counters are transmitted to four selector elements 12, 13, 14, and 15, each connected to a respective decoder 16, 17, 18, and 19, each decoder supplying a respective cell D1, D2, D3, and D4 for displaying a numeral or a letter. The four cells D1 to D4 make it possible to display two time indications of two numerals each, and the indications actually displayed are selected by selector elements 12–15. Thus cells D1 and D2 may display the hours or the minutes, and cells D3, D4 the minutes, the seconds, or the date. Moreover, cell D4 may display the indication P or A, standing for p.m or a.m. For selecting the data transmitted, selector elements 12–15 comprise a plurality of control inputs, two each for elements 15 and 14 and three each for elements 12 and 13. Usually, the data transmitted are those for the hours and minutes. The former arrive at cells D1, D2 and the latter at cells D3, D4. One of the control inputs of selectors 15 and 14 enables the hour display to be erased, while the other causes the minutes to appear on cells D1, D2. In the same way, one of the control inputs of selectors 12, 13 enables the minutes indication to be erased from cells D3, D4, the second one causes the seconds to appear, and the third causes the date to appear.

One of the functions of the control circuit to be described below is therefore to select the information displayed. When a selection signal is transmitted, i.e., when button BP is pressed while the circuit is in its normal state, the minutes and seconds appear in place of the hours and minutes. In addition, when the selection signal ceases, the date appears for two seconds on cells D3 and D4 while cells D1, D2 remain vacant. The indication A or P will appear during the adjustment phase, as will be described below.

The flashing point (dot or colon) DP which appears between cell groups D1/D2 and D3/D4 is fed by the 1-Hz signal derived from the output of the divider. Point DP disappears during the display of the date.

For transmitting the coded data from the counters to the selector elements, the connection between seconds counter 3 and selector element 12 comprises four conductors, whereas three conductors suffice for the data corresponding to the seconds counted by tens, transmitted to selector 13. The same numbers of lines are necessary between minute counter 5 and selector elements 12, 14, on the one hand, and 13, 15, on the other hand, while the transmission of the hour data, in the case of a 12-hour indication, requires one line for selector 15 and four lines for selector 14. Finally, for the date information, two lines are necessary between date counter 10 and selector 13, and four lines between that counter and selector 12. The indications on cells D1 to D4 are formed by using selectively energized segments. As is generally known, a seven-segment configuration makes it possible to form not only the numerals from 0 to 9, but also the letter A or the letter P, as desired; this possibility is utilized for cell D4, as will be described below.

At the input of each of the counters 3, 5, 7, and 10 there is an intervention element. Thus a simple blocking gate BS is placed at the input of seconds counter 3. A selector circuit 4 is inserted at the input of minute counter 5, while blocking circuits 6 and 8 are inserted at the inputs of hour counter 7 and date counter 10, respectively. Blocking circuit 8 is associated with an A/P-indicator circuit 9, connected (FIG. 1) to decoder 19 which controls cell D4.

The control circuit is composed of four elements: an input element 20, a time-lag element 21, a cyclical activating element 22, and a display selection element 23. These elements, with their main constituents, are shown in FIG. 2.

Input element 20 is connected to push button BP, which will be mounted on the watchcase. Element 20 processes the signals transmitted to the other elements. These signals must be free of disturbance, and for that purpose a flip-flop 201 is used, one input Cp of which is connected to the 64-Hz signal coming from divider 2. Input J of flip-flop 201 receives the signal from button BP directly, whereas input $\overline{K}$ receives this signal inverted via a gate 202. Output $\overline{Q}$ of flip-flop 201 is connected both to an intervention connection (A) and, via a group of three gates 204, 205, 206 and via two other flip-flops 203 and 207, to cyclical activating element 22. Flip-flop 203 flips on the leading edge of a signal A coming from flip-flop 201, while flip-flop 207 flips on the trailing edge of that signal. Flip-flop 203 supplies via a gate 208 a signal E which appears and disappears at the same time as signal A; and via its output $\overline{Q}$, flip-flop 203 supplies a signal B which appears with the leading edge of signal A but lasts until the end of the time-lag period determined by element 21. Element 21 is actuated by a signal C supplied by flip-flop 207 on the trailing edge of signal A. Normally, signal C has zero value. It blocks a NAND-gate 211 of element 21. It is inverted by a gate 214, so that a gate 213, which transmits the 64-Hz signal to the RESET input of a counter 212, normally receives a signal at a logic level of one. When signal C changes to one, gate 211 transmits the 64-Hz signal to the input of counter 212, while gate 213 blocks this same signal. Counter 212 is a binary counter dividing by $2^7$, so that 2 seconds after the appearance of signal C, it sends a zero pulse to the RESET output, which resets flip-flops 203 and 207. Signal B then returns to its normal value of one, while signal C returns to zero.

As has been stated previously, signal E appears only while push button BP is being pressed. It is transmitted to selection element 23. It passes through a NAND-gate 231 and inverters 235 and 236 to control inputs SEC and MIN 2 of the selectors.

As for signal B, it is transmitted to an AND-gate 232, then via OR-gates 237, 238, and 239 to the inputs MIN 1 and HR of the selectors.

Signal C is transmitted via an AND-gate 233 and an OR-gate 2310 to the control input DATE of the selectors.

The functions of the gates described above will be readily understood: as soon as signal B appears, i.e., when push button BP is pressed for the first time, the hour and minute indications normally displayed on the cells disappear. At the same time, the seconds and minute indications appear on cells D3, D4 and D1, D2, respectively, in response to signal E. When signal A ceases and signal C appears, the seconds and minute indications disappear, and the indication of the date appears in their place on cells D3, D4, this indication remaining as long as counter 212 is energized and, consequently, until the appearance of the RESET pulse. If no control order is given by push button BP while counter 212 is in operation, the display then automatically resumes its normal functions.

Display selection element 23 comprises a flip-flop 234 and a flip-flop 2312. The input of flip-flop 234 is connected to the output of a NAND-gate 221 which forms part of cyclical activating element 22, and the functions of which will be described further on. The output $\overline{Q}$ of flip-flop 234 is connected in parallel to the second inputs of gates 231, 232, and 233, as well as to one of the inputs of gate 221 and to one of the inputs of gate 204. Flip-flop 234 normally maintains its output Q at 1. When the adjustment phase is entered, i.e., if a second signal A is transmitted while counter 212 is energized, the three inputs of gate 221 are at 1, so that the output of this gate changes to zero (signal L), which causes flip-flop 234 to flip and produces a zero signal on a line D. This signal D blocks gates 231, 232, and 233. It likewise blocks gate 204, so that the succeeding signal or signals A are not transmitted to flip-flops 203 and 207. As for flip-flop 2312, it intervenes later on during the activating cycle, as will be described below.

Cyclical activating element 22 intervenes during the adjustment phase. It comprises an input channel which in turn comprises gate 221, which has already been mentioned, a flip-flop 222, and auxiliary gates 224, 225, and 2211. One of the outputs (Q) of flip-flop 222 is connected to the input of a shift register 223 constituting the essential part of cyclical activating element 22. Shift register 223 comprises another input Cp which is fed, via gate 225 and a divider 2212, by the 64-Hz signal. Divider 2212 divides by $2^8$, so that when gate 225 is conducting, it is a signal of one-quarter hertz which is transmitted to input Cp. When shift register 223 is energized by a pulse arriving at its input S1, it successively energizes its outputs A, B, C, and D for four seconds each.

The four output channels of shift register 223 respectively comprise four NAND-gates 226, 227, 228, and 2215, one of the inputs of each of which is connected to the corresponding output of shift register 223, the other input being directly connected to the line over which the signals A arrive, and the outputs of which lead to intervention elements BS, 4, 6, and 8. Thus gates 226, 227, and 228 are respectively connected to intervention elements 8, 6, and 4 by lines ARJ, ARH, and ARM. In parallel with these connections, the outputs of gates 226, 227, and 228 are connected to the inputs of a gate 229, which is in turn connected to gate 225. The output channel connected to output D of shift register 223 comprises, besides gate 2215, a JK flip-flop 2213, output $\overline{Q}$ of which is connected to the seconds-blocking gate BS.

Activating signals G, H, and I, supplied successively to outputs A, B, and C of shift register 223, are also transmitted to gates 238, 239, and 2310 of element 23, while an activating signal K supplied by output D of shift register 223 is conveyed to input Cp of flip-flop 2312.

Elements 22 and 23 further comprise an inverter gate 2214 which supplies a signal F to gate 237 and to a gate 2311 when the output of gate 2310 is energized. One input of gate 2311 is connected to the 1-Hz signal, while its output is connected to decoders 16, 17, 18, and 19. While signal F is being sent, the 1-Hz signal is therefore transmitted to the decoders and causes the indications then being displayed to flash.

The operation of the control circuit during the adjustment phase will be readily understood. As has been previously explained, when a signal A appears while counter 212 is operating, i.e., while input C of gate 221 is at one, signal L changes to zero, which causes signal D to change to zero. Gates 231, 232, and 233 being blocked, the display goes out. At the same time, flip-flop 222 flips, and shift register 223 is energized. If no operation is carried out with push button BP during the operating cycle of shift register 223, signals G, H, I, and K appear successively at outputs A, B, C, and D of shift register 223, for four seconds each, synchronized with the output of divider 2312. Each of the first three signals G, H, and I causes a time indication to appear on two of the display cells. Signal G controls the appearance of the date on cells D3, D4 via gate 2310, signal H controls the appearance of the hour on cells D1, D2 via gate 239, and signal I controls the appearance of the minutes on cells D3, D4 via gate 238. During the appearance of signal G, gate 224 is activated, so that upon the next pulse passing gate 225, hence at the moment when signal H appears, this pulse is transmitted via gate 2211 and causes flip-flop 222 to be reset.

When signal K appears under the conditions described here, i.e., without any intervention having taken place during the activating cycle, it has no effect upon the display and the counting. Only the trailing edge of signal K causes flip-flop 2312, and thus flip-flop 234, to flip. Signal D then changes back to one, and the control circuit as a whole is once more back to initial operating conditions.

If push button BP is pressed for a third time while either signal G or H is appearing at output A or output B of shift register 223, the corresponding gate 226 or 227 transmits this signal over line ARJ or ARH, i.e., to blocking circuit 8 or to blocking circuit 6. The circuit in question is energized and transmits, to counter 10 or to counter 7, a 2-Hz signal coming from an intermediate stage of divider 2 in the first instance, and a 1-Hz signal coming from the output of divider 2 in the second instance. Thus the corresponding counter rapidly advances at the rate of one unit per second, the respective indication being displayed as has been seen previously. Simultaneously with this transmission of the intervention signal to the desired intervention circuit, gate 229 transmits a blocking signal which blocks gate 225, so that the pulses which could cause shift register 223 to shift no longer pass. Transmission of these pulses will not be resumed until gate 229 has gone back to its normal state, i.e., at the end of the intervention signal.

If, during the transmission of signal ARH to circuit 6, hour counter 7 changes from the "12" state to the "1" state, which normally causes a pulse to be supplied to circuit 9, which divides by 2, this pulse is blocked. Moreover, during the transmission of signal ARH, the indication A or P processed by circuit 9 according to its state is transmitted to cell D4.

If the intervention signal is sent out over line A while signal I is appearing at output C of shift register 223, intervention signal ARM is transmitted, as in the preceding case, to minute selector circuit 4, so that counter 5 likewise advances at the rate of 1 Hz, counter 7 being blocked if counter 5 changes from "59" to "0". At the same time, the intervention signal is transmitted to flip-flop 2213 which, via its output $\overline{Q}$, blocks gate BS. In this case, when signal K appears, it actuates gate 2210 and transmits signal F. Gate 225 remains blocked, which extends the duration of signal K. The selectors remain controlled by signals MIN 1 and HR, so that the hour and minute indications remain displayed. In addition, this display starts to flash since gate 2311 is conducting.

In order to restore the control circuit to its normal state, a new pulse must then be sent out on line A, hence push button BP must be pressed once more. Both inputs of gate 2215 are then at one, which causes flip-flop 2213 to flip into its normal state. The blocking of the seconds ceases, so that counter 3 immediately resumes counting from zero. Furthermore, signal F ceases with the trailing edge of this unblocking order. Gate 225 is unblocked, so that upon the next pulse supplied by divider 2212, signal K ceases.

As has been seen above, the end of signal K causes the control circuit to return to its normal state by means of flip-flops 2313 and 234.

Figure 3:
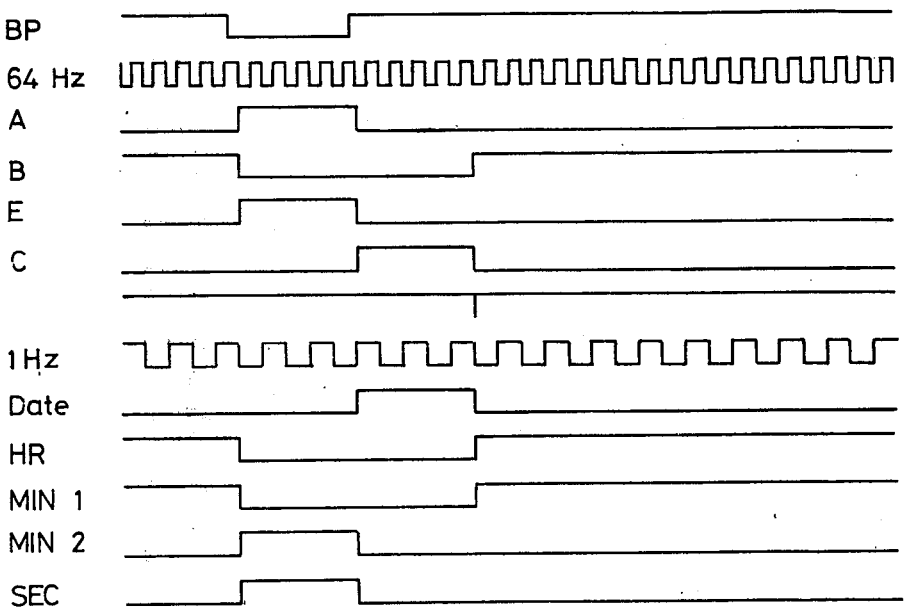
FIG. 3 is a graph illustrating the functions performed by the control member in the reading phase.
Figure 4:
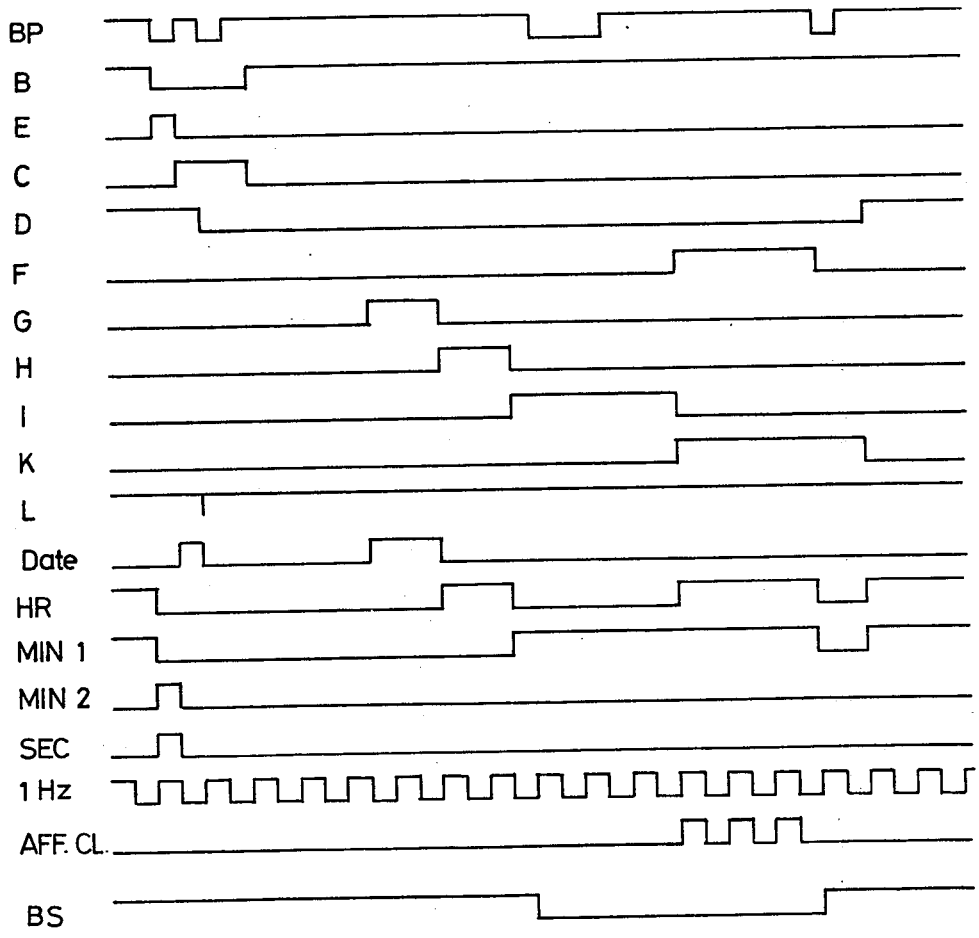
FIG. 4 is a graph illustrating the functions performed by the control member in the adjustment phase.

FIGS. 3 and 4 show diagrammatically the shapes of the various signals described above in the case of a reading phase and of an adjustment phase, respectively.

It will be seen in FIG. 3 that operation of push button BP gives rise to the appearance of signal A, which is formed in the input element owing to the 64-Hz signal. The appearance of signal A causes the appearance of signals B and E, the latter ending with signal A, whereas signal B lasts until the end of the energizing of counter 212, i.e., until the end of signal C, at which moment the RESET pulse appears.

Selector control signals HR and MIN 1 cause the usual display to be erased during the transmission of signal B, while the signal DATE causes the date to be displayed during the transmission of signal C, and signals MIN 2 and SEC cause the minute and the second to be displayed on the cells. Shown in FIG. 4 are the signals which appear when it is desired to make a correction in the minutes display. During the transmission of signal C, push button BP must be pressed again; this starts the energizing of shift register 223 and the appearance of zero signal D. Signals G and H appear successively for four seconds each with display of the date, then the hour, then signal I appears with display of the minutes. During this signal, push button BP is pressed for a third time, so that the duration of signal I is extended for the length of time necessary to correct the minutes and for the length of time necessary for the next pulse of a frequency of one-quarter hertz to arrive at shift register 223. At that moment, signal K appears, which is held up by flip-flop 2213 and gate 225. The minutes remain displayed, while the hours appear, these indications being flashing. Counting of the seconds having been blocked when push button BP was pressed for the third time, the blocking of the seconds and the flashing of the display will last until push button BP has been pressed for the fourth time. This fourth pressing of the push button causes signal F, and thus the flashing of the display, to cease. At the same time, gate 225 is unblocked, so that signals K and D will cease with the next one-quarter-hertz pulse.

The control circuit described above may easily be produced as an integrated circuit and incorporated into a circuit for the display of numerals and/or letters, controlling liquid crystal or LED cells. In the case of an LED display for a wrist watch, the display may be caused to appear either by means of another switch or by a preliminary operation of push button BP.

What is claimed is:

1. An electronic time piece comprising:

a plurality of display cells, a plurality of counters for processing data to be transmitted to said cells through a coupling device, a control circuit means for enabling modification of said data, said control circuit means comprising:

a switch, an input circuit energized by said switch and having first and second outputs for providing activating and intervention signals respectively, a cyclical activating circuit means having an input channel and a plurality of output channels, an input connection between said first output of said input circuit and said input channel, a plurality of selectively energized means coupled one each to said output channels and a plurality of intervention circuits coupled one each to said selectively energized means, each of said selectively energized means being conditioned for operation in response to actuation of a corresponding output channel for providing signals from said second output of said input circuit to a respective intervention circuit, each of said intervention circuits being connected to one of said counters, an intervention connection coupling together said second output of said input circuit, said input channel, and said plurality of selectively energized means, said activating circuit rendered operative in response to the concurrent presence at the input channel of an activating signal and an intervention signal, said signals issuing from said input circuit in response to at least one depression of said switch for causing the successive actuation of said output channels in a predetermined order each for a predetermined length of time, said actuation of an output channel for a said predetermined length of time conditioning for operation a respective selectively energized means for said predetermined length of time in such a manner that the issuing by said input circuit of a second intervention signal in response to a further depression of said switch during a said predetermined length of time provides said second intervention signal through said respective selectively energized means solely to that intervention circuit which is coupled to the output channel activated during said predetermined length of time.

2. An electronic time piece according to claim 1 wherein said coupling device includes a plurality of selector elements coupled to said input circuit for receiving selection signals from said input circuit, said input circuit having a timer circuit associated therewith, said timer circuit being responsive to the transmission of a predetermined one of said selection signals for causing said input circuit to provide said activating signal for a predetermined period of time, said timer circuit also blocking any further transmission of selection signals by said input circuit for said predetermined period of time.

3. An electronic time piece according to claim 2, wherein said counters include seconds, minute, hour, and date counters, and said display cells are each designed to display two two-digit indications, said predetermined one of said selection signals causing the display of the minutes and the seconds, and said first output causing the display of the date during said predetermined length of time.

4. An electronic time piece according to claim 2, further comprising connections for connecting at least some of said output channels to said selector elements, said connections being so disposed that during activation of said output channels, said display cells display said data processed by said counter associated with the particular said intervention circuit connected to said activated output channel.

5. An electronic time piece according to claim 4, wherein one of said intervention circuits associated with a said seconds counter is a blocking gate, said output channels being so disposed that a said intervention signal transmitted during activation of a said output channel corresponding to a said minute counter causes, via said blocking gate, the stopping of said seconds counter, and a said intervention signal transmitted during activation of said output channel corresponding to said seconds counter causing unblocking of said blocking gate.

6. An electronic time piece according to claim 5, wherein said control circuit is so designed that the period of activation of said output channel corresponding to said seconds counter is extended until the appearance of an unblocking signal when a said intervention signal has been transmitted while said output channel corresponding to said minute counter is activated.

7. An electronic time piece according to claim 6, further comprising a connection between said cyclical activating circuit and said display cells for causing said display cells to flash during the length of time between energizing and de-energizing of said blocking gate.

8. An electronic time piece according to claim 1, wherein said cyclical activating circuit comprises a shift register.

9. An electronic time piece according to claim 2, wherein said cyclical activating circuit comprises a shift register and said input channel comprises a JK flip-flop and a NAND-gate, the output of said NAND-gate being connected to the input of said flip-flop, the first input of said NAND-gate being connected to receive said second output of said input circuit, the second input of said NAND-gate being connected to receive the first output of said input circuit, and the third input of said NAND-gate being connected to a normally activated line which is deactivated upon the concurrent transmission of an activating and an intervention signal, the leading edge of a first said selection signal energizing said selector elements and the trailing edge thereof de-energizing said selector elements and actuating said timer, said cyclical activating circuit rendered operative upon transmission of an intervention signal during energizing of said timer, said intervention connection providing further intervention singals transmitted during energizing of said cyclical activating element to said selectively energized means.

10. An electronic time piece according to claim 1, wherein said switch is controlled by a single push button which closes said switch when pressed and which opens said switch when released.

* * * * *